United States Patent [19]

Nuver

[11] 4,144,478

[45] Mar. 13, 1979

[54] LAMP SYSTEM TAKE CONTROL DIMMING CIRCUIT

[75] Inventor: Eric L. H. Nuver, San Marcos, Tex.

[73] Assignee: Esquire, Inc., New York, N.Y.

[21] Appl. No.: 823,710

[22] Filed: Aug. 11, 1977

[51] Int. Cl.[2] ..... H05B 37/02; H05B 39/04

[52] U.S. Cl. ..... 315/291; 315/199; 315/361; 315/DIG. 4; 323/17

[58] Field of Search ..... 315/361, 291, 299, 300, 315/194, 199, DIG. 4; 323/17; 307/296; 328/172

[56] References Cited

U.S. PATENT DOCUMENTS

| | | | |
|---|---|---|---|
| 3,787,734 | 1/1974 | Dorler et al. | 307/296 X |
| 3,868,546 | 2/1975 | Gilbreath et al. | 315/361 X |

*Primary Examiner*—Eugene R. LaRoche

*Attorney, Agent, or Firm*—Frank S. Vaden, III

[57] ABSTRACT

A circuit for providing remote control at a plurality of locations for a lighting system, such control functions including on/off, dimming intensity and rate of dimming. Visual indication of take control is also provided.

10 Claims, 7 Drawing Figures

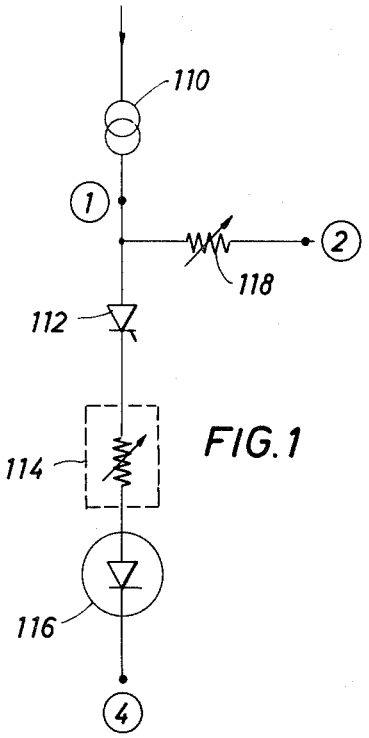
FIG. 1
FIG. 2
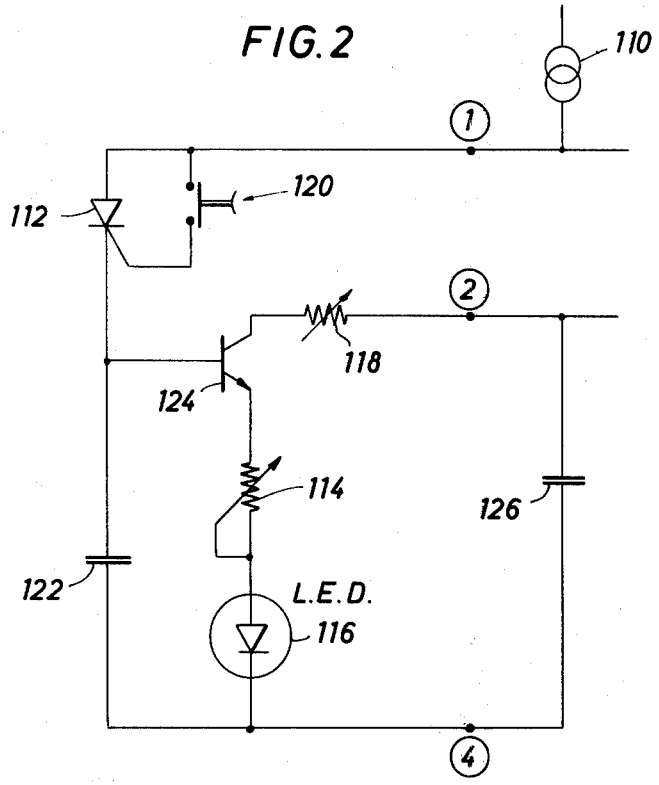
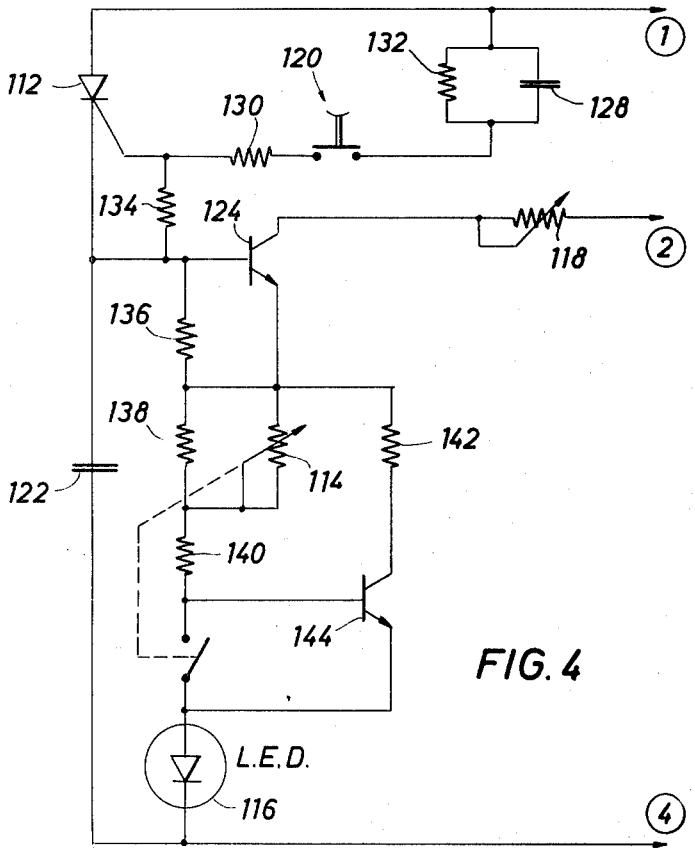
FIG. 4
FIG. 5
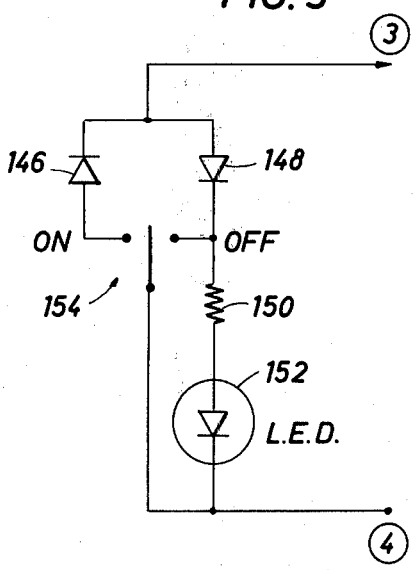

HIGH
LOW
VAR
HIGH
LOW 1
2
4

128
130
132
120a
120b
120c
120d
112a
112b
112c
112d
118a
118b
118c
118d
134a
134b
134c
134d
124a
124b
124c
124d
136a
136b
136c
136d
138a
114a
114b
114c
114d
156
116a
116b
116c
116d
L.E.D.
122a
122b
122c
122d

LAMP SYSTEM TAKE CONTROL DIMMING CIRCUIT

BACKGROUND OF THE INVENTION

1. Field of the Invention

This invention pertains to control circuits for lighting systems and more particularly to control circuits permitting remote take control of dimming operations, rate of dimming and the like in high intensity discharge lamp systems.

2. Description of the Prior Art

It is only a fairly recent development that high intensity lighting systems have been equipped with the capacity to dim. The advent of this development is represented by the dimming circuit shown in U.S. Pat. No. 3,816,794. More recently, a more sophisticated system has been developed, as disclosed in U.S. Pat. No. 3,894,265.

Lighting systems with which such a dimming circuit are employed are often quite large, involving tens and sometimes even hundreds of individual lights deployed over large areas. It is a distinct advantage to be able to control the system from more than one location, such as at two doorway locations at the opposite ends of a large building. In fact, it is very desirable to have the ability to provide full control at numerous locations.

Through experience, it has developed that it is not only desirable to change the amount of light intensity of a lighting system, but also to change the rate of intensity change from bright to dim or from dim to bright.

Therefore, it is a feature of the present invention to provide improved apparatus for permitting the full take over of dimming controls for a high intensity lighting system at a plurality of locations.

It is another feature of the present invention to provide an improved apparatus for permitting full takeover of intensity and rate of dimming for a high intensity discharge system at a plurality of locations.

It is still another feature of the present invention to provide an improved apparatus for permitting full takeover of on/off and of dimming functions for a high intensity discharge system at a plurality of locations, a visual indication also being provided to indicated that a given "take control" station is operating the system.

SUMMARY OF THE INVENTION

A preferred embodiment of the invention comprises equipping each take control station with a gated semiconductor device connected to a constant current generator. A variable electronic resistor connected to the device establishes the intensity control to a common dimming network, the gate control to the device determining the operation of the device.

A rate control having a time constant network is connected through a semiconductor to the electronic resistor. The setting of a resistor in this time constant network determines the rate of intensity change each time the variable electronic resistor is changed to change the intensity.

An L. E. D. device is used at each take control station to show when that station is operating. Switching means is included at the take control stations and in a common interface network to ensure that all other stations except the one in charge are disconnected. This interface network also includes an electronic capacitance multiplier as part of the time constant network and various voltage compensating devices to ensure reliable operations.

BRIEF DESCRIPTION OF THE DRAWINGS

So that the manner in which the above-recited features, advantages and objects of the invention, as well as others which will become apparent are attained and can be understood in detail, more particular description of the invention briefly summarized above may be had by reference to the embodiments thereof which are illustrated in the appended drawings, which drawings form a part of this specification. It is noted, however, that the appended drawings illustrate only typical embodiments of the invention and are therefore not to be considered limiting of its scope, for the invention may admit to other equally effective embodiments.

In the drawings:

FIG. 1 is a simplified schematic of the principal components of a take control station in the present invention.

FIG. 2 is a simplified schematic in somewhat expanded form of the schematic illustrated in FIG. 1, also showing interconnection with the interface network of the present invention.

FIG. 4 is a schematic diagram of a single station take control station in accordance with a preferred embodiment of the present invention.

FIG. 5 is a schematic diagram of an on/off switching network for a take control station of the present invention.

DESCRIPTION OF THE PREFERRED EMBODIMENTS

Figure 3:
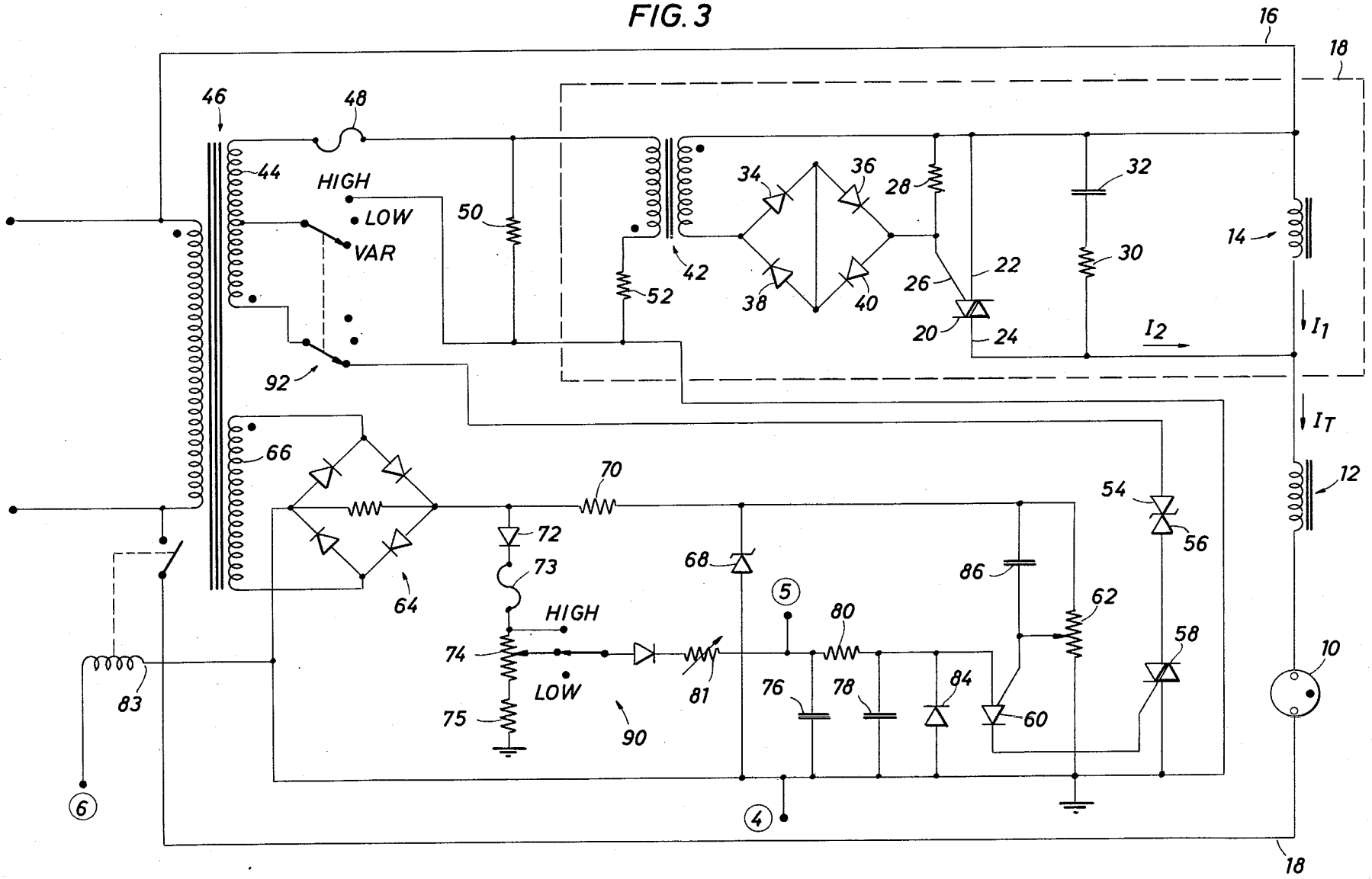
FIG. 3 is a schematic diagram of a suitable dimming circuit for a lighting system, with which the take control circuit of the present invention can be operated.

Now referring to the drawings and first to FIG. 1, a simplified schematic of a single take control station is illustrated. Such a station operates in conjunction with an interface network and with a lighting system operated by a master control station, both of which are described hereinafter. However, several features of a take control station may be observed by reference to the simplified schematic.

First, the take control station operates in conjunction with a constant current generator 110 located in the interface network connected to terminal 1, a large capacitance located in the interface network connected to terminal 2 and a common terminal 4. The current generator supplies a nominal 10 milliampere current to the circuit. The take control station includes, in series with the current generator, a transistor switch embodied as SCR 112, a variable voltage device, illustrated as a variable resistor 114, and a visual indicator, illustrated as light emitting diode (L. E. D.) 116. Also included is variable resistor 118 connected between terminal 2 and the anode of the SCR. Variable resistor 114 provides means for varying the dc level of the voltage on terminals 4 and 2, and hence operates as an intensity control, and resistor 118 provides means for controlling the current flow from terminal 1 to terminal 2, and hence operates as a rate control.

Current source 110 in FIG. 1, in combination with elements 112, 114 and 116, forms a variable voltage source with variable output impedance charging or discharging capacitor 126 in FIG. 2, the desired voltage level being at a rate determined by the setting of resistor 118.

Referring to FIG. 2, a slightly expanded version of the circuit shown in FIG. 1 is illustrated, similar components being identically marked, for convenience.

Connected from the gate to the anode of SCR 112 is switch 120. Momentary closing of the switch applies a gate trigger to the SCR, which puts it into conduction and allows the station illustrated to "take control" of the operation of the system. Conduction of the SCR provides bias capacitor 122 with current. After a short period of time, npn transistor 124, connected to the cathode of SCR 112 and to capacitor 122, is biased into condition, thereby providing a circuit through the emitter-collector of transistor 124. Completion of this connection supplies current to L. E. D. 116 to light this L. E. D. as an indication that this take control station is now in control of system operation. The setting of variable resistor 114 determines the absolute voltage level applied to terminal 2, and hence is the intensity control. A high position setting puts a large value of resistance in the circuit, i.e., the level setting is proportional to the value of the resistance. A low position inserts a lessor resistor value into the circuit and is the lowest variable setting. A latching connection setting at its low end is equivalent to a zero value resistor in the circuit, and, hence, represents the lowest setting.

Capacitor 126 in the interface network connected to terminal 2 may be thought of as a memory capacitor. The voltage level on this capacitor had been previously set by the station in charge of the system before the present station has been switched to take control. If the value of the voltage as determined by the setting of resistor 114 is the same as previously established on capacitor 126, then there is no change. If, however, there is a voltage level change, the resistance of resistor 118 represents a time constant value with capacitor 126 and determines if the voltage value thereon reaches its new value quickly or slowly. Hence, the setting of resistor 118 determines the rate of change of this voltage level.

Operation of transistor 124 under assumed voltage conditions reveals more fully the operation of the voltage changes on capacitor 126. When transistor 124 conducts, the collector may either be positive or negative with respect to the emitter value. If the collector happens to be positive, then transistor 124 saturates and it functions as a normal transistor. On the other hand, if the collector happens to be negative, then the transistor acts like a diode through its base-collector junction, permitting the voltage level on capacitor 126 to readjust to the new setting at a rate cooperatively determined by the setting of resistor 118.

Now referring to FIG. 3, high intensity discharge lamp 10 is connected in series with two inductive ballast elements 12 and 14, the entire combination being connected between lines 16 and 18. Gated bypass means in the form of triac 20 is connected across element 14, first main terminal 22 of the triac being connected to line 16 and second main terminal 24 being connected to a junction between the two inductive ballast elements. Gate terminal 26 is connected to shunt resistor 28, which is also connected to line 16. Resistor 30 and capacitor 32, connected in series with each other and in parallel with element 14, are provided as a snubber device to provide triac 20 immunity from commutating dv/dt false turn on. Two pairs of diodes 34 and 36 and 38 and 40 connected to gate 26 provide the gate source voltage to triac 20 from transformer 42. These diodes are connected so that two diodes 34 and 36 face forward and two diodes 38 and 40 face backwards, with the junction point between each pair being connected together. Diodes 34, 36, 38 and 40 provide a slight forward voltage drop to block out the residual magnetizing force from transformer 42 and to thereby prevent false firing of triac 20. Everything between and including transformer 42 and its accompanying series resistor 52, and inductor 14 may be considered to be in triac module 15.

When triac 20 is conducting to form a complete bypass around element 14, a maximum amount of current flows through lamp 10. On the other hand, when triac 20 is not conducting, then the minimum amount of current flows through lamp 10. By allowing triac 20 to conduct for part of the cycle, then the current through lamp 10, and hence the illumination therefrom, may be varied between the dim lamp current and full lamp current values. Merely controlling the period of conduction of triac 20 will achieve controllable illumination of lamp 10.

Control of the conduction of triac 20 is accomplished by the controllable gate voltage means connected to transformer 42. To understand the operation of the control circuit, some additional phase relationships have to be appreciated. The voltage across element 14 (reactor voltage) is leading lamp current by approximately 85° and also is leading the line voltage by approximately 30°.

Triac 20 should not be rendered conductive until the current through and the voltage across element 14 are both of the same polarity, either both positive or both negative. If triac 20 where rendered conductive when the voltage across element 14 and the current therethrough were not of the same polarity, a phenomenon known as "half cycle conduction" would occur. The lamp would appear to flash from dim to fully bright each half cycle and would produce an irritating strobing effect to the eye that would also be harmful to the lamp.

Power is applied to transformer 42 via the secondary 44 of power transformer 46, whose primary is connected across lines 16 and 18. One terminal of secondary 44 is connected to fuse or circuit breaker 48. Load resistors 50 and 52 connected to the two sides of the primary of transformer 42 are connected to ground. The power connection from the secondary 44 of transformer 46 to the primary of transformer 42 is through a bidirectional voltage regulating means in the form of cathode-to-cathode Zener diodes 54 and 56 and triac 58. It is well-known that alternatively Zener diodes 54 and 56 may be connected anode-to-anode and operate in the same manner.

It may be seen that cathode-to-cathode Zener diodes 54 and 56 are connected in series with the main terminals of triac 58, the entire combination being connected as previously mentioned in series with secondary 44 of transformer 46. It is readily apparent that the gate voltage has for its source from secondary 44 a voltage which is in phase with the voltage across lines 16 and 18.

Connected to the gate terminal of triac 58 is the cathode of programmable unijunction transistor (PUT) 60. The gate connection to PUT 60 is connected to a rectified dc voltage via variable resistor 62. The timing of the conduction of PUT 60 is determined by the voltage differential between the voltage applied via resistor 62 and the voltage applied to the anode of PUT 60. Both the voltage applied to the anode and to the gate of PUT 60 are important to its conduction. The anode voltage must be slightly larger than the gate voltage to cause conduction. That is, conduction is dependent on the arithmetic difference between the voltage applied to the anode and gate. Therefore, the setting of resistor 62 "programs" what anode voltage is required to produce conduction. The dc voltage applied to resistor 62 is developed by bridge rectifier 64 connected to secondary 66 of transformer 46. A Zener diode 68 and current limiting resistor 70 ensure that the voltage applied to resistor 62 never exceeds a predetermined value.

The output from bridge rectifier 64 is also connected through diode 72, fuse 73 and variable resistor 74 to a time constant control network connected to the anode of PUT 60. This time constant network includes capacitors 76 and 78 and resistor 80. A diode 82 is included in series with the voltage from resistor 74.

A diode 84 in the anode circuit of PUT 60 and capacitor 86 in the gate circuit of PUT 60 ensure positive reset of PUT 60 following conduction. It should be noted that the operating adjustment for PUT 60 is determined by variable resistor 62. The ultimate control for determining the amount of brightness of lamp 10 is determined by the setting of resistor 74. As PUT 60 ages, the setting of resistor 62 can be changed, as well as permitting an easy setting for initial conditions.

In operation, programmable unijunction transistor 60 is turned on by the voltage difference between the voltage on the anode of PUT 60 (voltage on capacitor 78) and the voltage on the movable contact of resistor 62. On each cycle of ac voltage applied to the bridge, there is a rise to a dc level at the output of this bridge for application to the gate of PUT 60 through resistor 62. In a more sluggish fashion, a voltage determined by the setting of resistor 74 will be applied to the anode of PUT 60. When the difference in these two voltages is reduced at the gate and anode of PUT 60 to the point of causing conduction, a gate voltage is supplied to triac 58. Triac 58 conducts when the secondary voltage of 44 applied thereto exceeds the Zener diode voltage of diodes 54 and 56. When diodes 54 and 56 conduct, there is a complete circuit in secondary winding 44 of transformer 46.

Yet another method of achieving the desired timing of PUT 60 to achieve firing, even without Zener diodes 54 and 56, may be accomplished by selecting the components of resistor 74, resistor 75, which is connected between resistor 74 and ground, resistor 80, capacitor 78, the voltage determined by Zener diode 68, and the setting of the voltage on the gate of PUT 60 by the setting of the movable arm on resistor 62. The setting is determined by placing variable resistance 74 at its lowest or dim setting.

If triac 20 is not gated on, no $I_2$ current flows through triac 20 and the only current flow through the lamp ($I_T$) is the current $I_1$ through reactor 14. This is reflected as the "dim state". On the other hand, if triac 20 is gated on during the entire time, then the entire current is bypassed around reactor 14 and through triac 20. Hence, $I_1$ becomes essentially zero and $I_T$ equals $I_2$. This is the "full on state" condition.

It is necessary that the gate voltage is prevented from continuing past the gate cutoff point. Although the gate voltage may be readily controlled by Zener clipping, other appropriate circuit means may be used for controlling the gate voltage to prevent voltage past the gate cutoff point from energizing the triac.

Further, it is assumed that the ballasting is such that the line voltage, and hence the reactor voltage, leads the lamp current. Should there be a lagging situation so that the phase relationships are the other way, gating means may be provided so that the gate range would still only be while the reactor voltage and lamp current are of the same polarity.

Once conduction of triac 20 is started, the gate source voltage must return to zero before the reactor voltage reverses polarity. This is accomplished by the Zener diodes cutting off when the gate source voltage applied thereto falls below a predetermined value.

The turn off point of the Zener diodes does not vary. It is apparent, however, that the shutting off of the Zener diodes and hence the gate source voltage to triac 20 does not instantaneously render triac 20 nonconductive. The inductance of elements 12 and 14 causes current to continue through triac 20 until the reactor current crosses zero and the triac commutates. The current through lamp 10, after such commutation, is only current through reactor 14.

Two switches are provided, either of which may be used to replace the variable control of the circuit to a full bright or full dim operation, if desired. Switch 90 is connected between diode 82 and resistor 74. This switch is a three-position switch. When it is placed to its center connection, connection is made to the variable contact of resistor 74 and operation is as previously described for variable control operation. When placed to the HIGH position, contact is made to the top of resistor 74 and the greatest amount of voltage is applied. The LOW position of the switch disconnects voltage from diode 82.

In operation, the highest setting of resistor 74 causes the anode voltage applied to PUT 60 to reach the level of firing the PUT in the shortest period of time. This assures gate voltage to triac 20 and hence full lamp current to lamp 10, as explained above. Absence of voltage, or low voltage operation, achieves the opposite effect.

Alternatively, switch 92 may be used to achieve high (full brightness) or low (dim) operation. In the LOW position of switch 92, there is a disconnect of transformer 46 from transformer 42. This means that no gate voltage is provided triac 20 and hence dim current is always supplied to lamp 10. In the HIGH position of switch 92, a center-tap connection is made from secondary 44 of transformer 46 to transformer 42. This supplies all the gate voltage that is necessary to keep the triac conducting the maximum amount of time and therefore supplies full lamp current to lamp 10. Only part of transformer secondary 44 is used since switch 92 provides operation without having to supply power also to the variable control circuit.

Reset operation of PUT 60 involves capacitor 86, capacitor 78, which is somewhat smaller than capacitor 86, diode 84 and triac 58. As already mentioned, when the exponential voltage rise on the anode of PUT 60 reaches a value that is a predetermined difference to the voltage applied to the gate of PUT 60, PUT 60 conducts. Assuming that the anode voltage never reaches the critical level with respect to the steady state dc level on the gate for conduction, PUT 60 will conduct nevertheless because the voltage on the gate of PUT 60 reduces until the critical predetermined voltage difference between gate and anode exists. In other words, there is a force firing of PUT 60. The firing of PUT 60 is caused by capacitor 86 discharging through the path comprising resistor 70, the resistor in the center of bridge 64, capacitor 78 and the anode-to-gate path of PUT 60.

When PUT 60 turns on, capacitor 78 discharges through the PUT and triggers triac 58. If the secondary voltage of 44 exceeds the Zener threshold voltage of Zener diodes 54 and 56, then the gate source voltage from this control circuit is produced, as previously described. In any event, because capacitor 86 is bigger than capacitor 78, eventually diode 84 conducts to cause a slight reverse build-up on capacitor 78. Since triac 58 commutates, the cathode of PUT 60 becomes zero, and hence there is an anode-to-cathode reverse bias which turns off the PUT. Moreover, when the line again begins to build-up, the gate voltage of PUT 60 rises to further ensure that gate current stops until the rising voltage on the anode again establishes conduction conditions.

Variable resistor 81 is connected in series between diode 82 and resistor 80 to provide an additional resistive element to the RC time constant determining voltage build-up on capacitors 76 and 78. This series resistor allows a manual setting of the rate of build-up or drop off in the light setting with a change of setting of the wiper on resistor 74. Terminals 4, 5 and 6 provide connection points for the interface network to the lighting system just described. Terminal 6 merely provides power to a latching relay 83 when there is power supplied to the interface network for closing contacts to the power lines and, hence, providing power to the system. Terminal 5 provides a connection to the system for varying the critical voltage level that controls the dimming operation just described. This is where the results are applied of the interface network, that received a signal from the take control station in command of the system. Terminal 4 is the common connection, which may also be ground, as shown.

Now referring to FIG. 4, an actual single take control station schematic diagram is shown, similar parts being identically numbered in accordance with the scheme set forth in the simplified diagrams shown in FIGS. 1 and 2. To turn on SCR 112 from the constant current source connected to terminal 1, it is necessary to close switch 120, which, for convenience, is merely a push button. Prior to the closing of the switch there was some voltage on the anode, but no voltage on the cathode. The closing of the switch provides a charging path for capacitor 128 through the switch, through limiting resistor 130, to the gate of the SCR. Resistor 132 connected in parallel with capacitor 128 discharges capacitor 128 after push button 120 is released, thereby interrupting the gate current to SCR 112. Resistor 134 limits the gate voltage build-up due to SCR gate leakage current.

When the voltage level builds up on the base of transistor 124, it conducts, as previously discussed. Resistor 136 is a leakage bypass resistor. The remainder of the components connected between L. E. D. 116 and transistor 124 are range limiting components for the basic variable resistor 114. If resistor 114 is not in its lowest position, which also is its switch latching position, then the variable portion determines the voltage level on the emitter, as limited by resistor 138 connected thereacross, resistor 140 connected in series with the parallel combination of 114 and 138, and resistor 142 connected via transistor 144 across resistors 114, 138 and 140. Latching of resistor 114 in the low position turns on transistor 144 to provide a discontinuity step to a low voltage below the variable range that exists when the transistor is not conducting. The purpose of this is explained hereinafter.

Now referring to FIG. 5, a take control power on/off station switch and indicator is shown. Terminal 3 is connected in the interface network to the contacts of a latching relay. Connected to one set of contacts is a diode connected in the same polarity arrangement as diode 146 of the FIG. 5 circuit and connected to another set of contacts is a diode connected in the same polarity as diode 148. The latching relay in the interface network, after push button 154 has been momentarily depressed into the "on" position, latches to this "on" position, thereby initially providing power to the lighting system. In the presence of a power interruption and restoration, this interface network latching relay switch does not drop out, but remains in. Positive half cycles of the restored voltage are passed through the latching relay contacts and the similarly aligned diode in the interface network and through diode 148, limiting resistor 150 to L. E. D. 152, to show the presence of restored power.

In summary, therefore, if the light does not come on, then to provide power to the system it is necessary to close spring-loaded switch 154 to the "on" position, which, through the operation of the latching relay circuit in the interface network, causes the latching relay contacts to switch over to the "on" position. Finally, if the light is on at the take control system and it is desired to turn the system off, then momentary switching of switch 154 to the "off" position provides this disconnection. Operation of the latching relay in the interface network is discussed more fully in conjunction with the discussion of the interface network.

Figure 6:
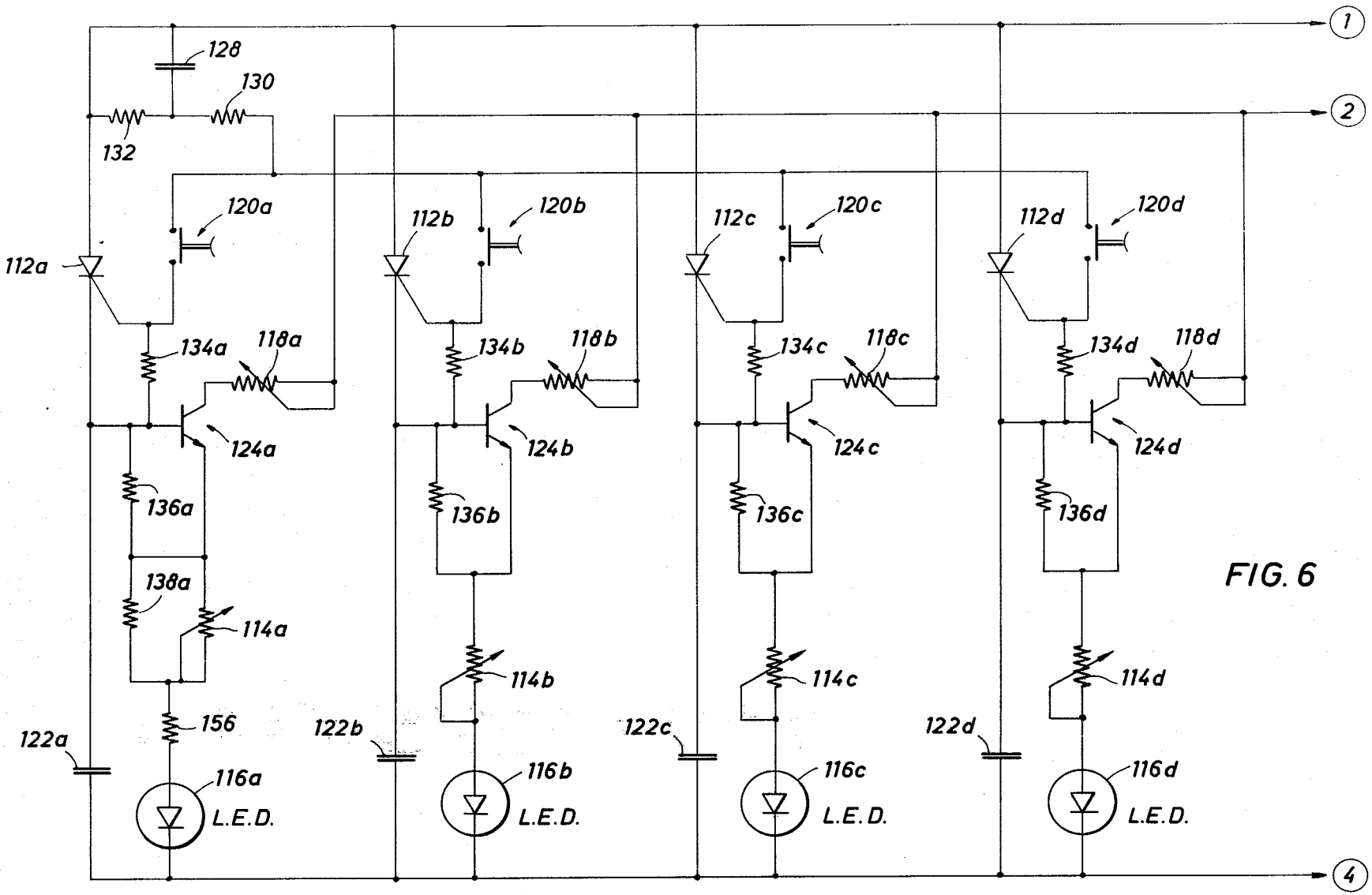
FIG. 6 is a schematic diagram of a four-station take control station network in accordance with a preferred embodiment of the present invention.

Now referring to FIG. 6, a four-station take control system is shown. With such an arrangement, an operator at any one of the stations can take complete control of the entire system and control the intensity of the lights and the rate of change of intensity. As discussed with respect to the single station arrangement, like numbers are used to identify the component parts of each station, the numbers being supplemented with "a", "b", "c", and "d" for the respective four stations. Where the parts are similar to the component parts of the single station take control circuit shown in FIG. 4, the numbers match with these numbers, as well.

The only differences between the individual take control networks in the four-station system and the single station network shown in FIG. 4 are with respect to simplified arrangements for the variable intensity resistor arrangements. Unlike the single station take control circuit shown in FIG. 4, there is no transistor 144. Further, at the "b", "c" and "d" stations, variable intensity control resistors **114*b*, 114*c* and 114*d* are not connected in parallel with another resistor. Finally, at station "a", the L. E. D. has an additional in-series resistor 156** connected thereto.

When there are multiple stations, not only is it necessary for the respective push buttons **120*a*, 120*b*, 120*c* or 120*d* to operate to take control for the station operated, the other stations must be affirmatively disconnected. Assuming switch 120*a* is momentarily shut, not only is the required gate signal applied to SCR 112*a*, but also the anodes of SCR's 112*b*, 112*c*, and 112*d* connected to line 1 are all pulled slightly negative with respect to their cathodes, causing cut-off to occur of whichever SCR was conducting prior to the closing of switch 120a. As soon as that SCR 112 stops conducting, the associated transistor 124 will no longer receive base drive, so that its base and emitter voltages will drop to zero volts. The collector will not conduct any current any longer (except leakage), and the take control station is not only effectively disconnected from line 1, but also from line 2**.

Figure 7:
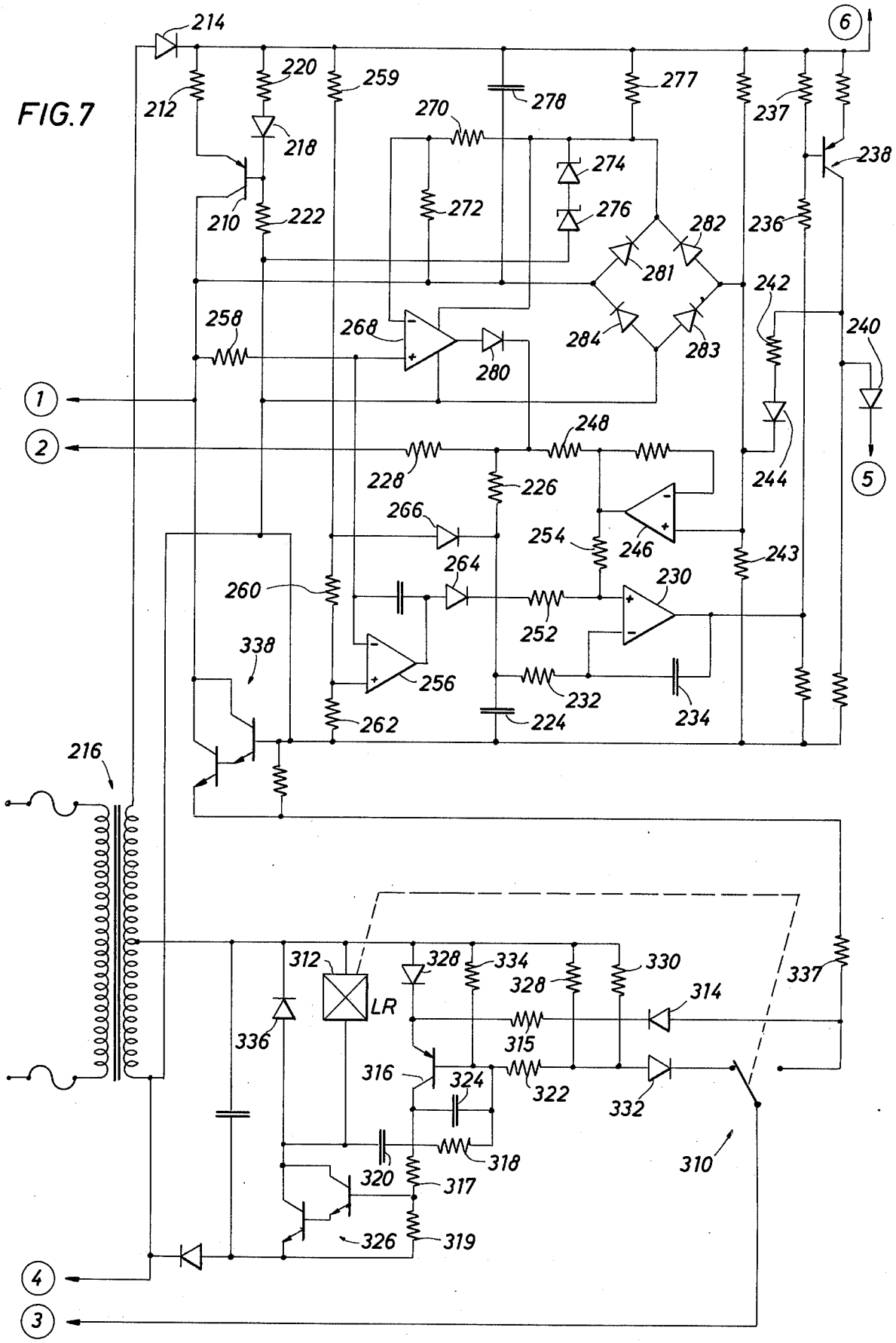
FIG. 7 is a schematic diagram of an interface network of a preferred embodiment of the take control circuit of the present invention.

Now referring to FIG. 7, a schematic of the interface network is shown. The various componets perform a number of different functions.

Terminal 1 is connected to the collector of a pnp transistor 210, whose emitter is connected through emitter resistor 212 and diode 214 to ac transformer 216. The base of transistor 210 is connected through diode 218 and resistor 220 to diode 214 and through resistor 222 to the common lead. These components comprise the constant current generator 110 previously discussed in conjunction with FIGS. 1 and 2.

Terminal 2 is connected to an electronic capacitance multiplier, which acts as the simplified capacitor illustrated as capacitor 126 in FIG. 2. A memory capacitor 224 is connected to terminal 2 through resistors 226 and 228 and connects to the input of an operational amplifier 230, together with the components of a high frequency filter comprising resistor 232 and capacitor 234. Resistor 228 is a stop resistor ensuring the low limit to which the external rate resistor in the take control circuit can be set. Operational amplifier 230 operates in the analog linear mode and supplies its output through resistors 236 and 237 to output transistor 238. The collector of transistor 238 is connected to output terminal 5 through diode 240 and is connected back through a voltage dividing network comprising resistor 242, isolation diode 244, and resistor 243 to noninverting buffer operational amplifier 246. The ouput of this operational amplifier through resistor 248 completes the basic connection for the electronic capacitance multiplier. Resistor 248 is typically about a 1000-ohm resistor and resistor 226 is typically about a 1-megohm resistor, thereby achieving a multiplication ratio of about 1000. It should be noted that resistor 254 to operational amplifier 230 is the same value as resistor 226. Hence, amplifier 246 acts like a voltage follower or buffer amplifier with a net gain of 1.

There is a connection to the reference terminal of operational amplifier 230 through resistor 252. The voltage on this resistor may vary to have an overriding effect on the level of voltage on capacitor 224.

Operational amplifier 256 has a sensing input connected through resistor 258 to terminal 1. The reference level is determined by voltage divider action from the line to terminal 6 by resistors 259, 260 and 262. When the sensed level from terminal 1 goes below the reference level at the positive input, then the output level from operational amplifier 256 goes up, causing conduction of diode 264 and an adjustment of the reference level to operational amplifier 230. In case all remote stations are off, no input signal is received at terminal 2, so that the voltage at that point drops to a low value. However, the voltage across capacitor 224 is kept at a level determined by the voltage at the junction of resistor 259 and 260, minus a voltage drop of diode 266. This level corresponds to a dim light setting, so that when a remote station is energized, capacitor 224 will already have an initial "dim" charge, rather than having to be charged up from zero.

Operational amplifier 268, connected for operation as dc comparator, is useful in providing a possible override connection to operational amplifier 230 when the take control station SCR's are all disconnected. When this occurs the junction between resistors 270 and 272 connected as an input may be exceeded by the voltage on terminal 1 through resistor 258. Note that the voltage of the reference connection is set by Zener diodes 274 and 276 through resistor 277 and through capacitor 278. When the terminal 1 level exceeds the reference level at resistors 270 and 272, diode 280 connected to the output of comparator 268 conducts to override the sensing level of terminal 2 applied to resistor 226. Diodes 281, 282, 283 and 284 are connected in pairs for transient reduction.

In operation, it may be seen that the reference level to operational amplifier 256 floats with the level on the line to terminal 6, whereas the reference level to comparator 268 is set by the Zener diodes. The sensing connection to each, however, is at the same point.

Now referring to the lower part of the diagram, the on/off system having a memory is shown. If contacts 310 of latching relay 312 are in the "OFF" position, then a signal is required to cause the latching relay to switch from the "OFF" position to the "ON" position. The "OFF" position signifies that no power is supplied to the lighting load, and that none of the take control stations are in control. The master control shown in FIG. 3 is always energized, awaiting an instruction to energize the lighting load.

Placing the take control station on/off switch 154 shown in FIG. 5 in the "ON" position while interface latching relay contacts 310 are in the "OFF" position completes a path through diode 314, through resistor 315, through transistor 316, to resistors 317 and 319, thus biasing transistor 326. Transistors 316 and 326 form a modified multistable multivibrator whose time constant is determined mainly by resistor 318 and capacitor 320. Transistor 316 acts in a grounded base mode. Once transistor 316 is conducting, its emitting circuit flows through diode 328. Resistor 322 and capacitor 324 are a spike filtering system. Transistor 326, illustrated as a Darlington pair, is operated full on by regenerative action to cause the latching action to act in a positive manner, thus placing switching contacts 310 to the "ON" position. A second set of contacts, via a relay in the master control box (not shown), will energize a lighting load contactor in the ac power lines.

When contacts are already in the "ON" position and power is reestablished after an outage, it is not necessary to place switch 154 in the "ON" position. If desired, deenergizing the lighting load can be achieved by placing switch 154 temporarily in the "OFF" position. When switch 154 is placed in the "OFF" position, the cathode of diode 148 is then placed to the common voltage level during positive half cycles of applied voltage. A path exists for the positive half cycles from transformer 216, through resistors 328 and 330 and diode 332, through contacts 310 via line 3 to diode 148 and to ground. The voltage across resistor 328 is divided by resistors 322 and 334, to develop the bias voltage to make transistor 316 conductive, now in a grounded emitter mode. The same regenerative process, takes place a previously discussed forcing latching relay 312 to change the position of its contacts.

It should be further observed that when none of the take control stations are operating and hence contacts 310 are to "OFF", then transistor switch 338 is pulled down to zero each half cycle. With none of the take control stations operating, the voltage at connection terminal 1 will be high, because current source transistor 210 conducts fully. This makes the output of comparator 268 high, pulling the junction of resistor 248 and resistor 226 up, so that the voltage on capacitor 224 quickly goes to a high level. This causes amplifier 230 to deliver a low output voltage, causing transistor 238 to conduct fully and causing the output voltage at connection terminal 5 also to become high. Thus, the connected dimmer master control box (FIG. 3) drives a lighting load up to a full power level when no take control station is in the circuit.

Without comparator 268, overriding signals at connection terminal 2, the output voltage at terminal 5, as well as the resulting light level, would not be well determined. When the system power is off, only the lighting power is off. However, the interface circuit as well as the master controller are continuously energized. It would be useless to have any take control station operating with an LED 116 on when the main lights are not energized. To prevent any take control station from being energized under such conditions, transistor 338 is incorporated. It is made to conduct fully every negative half cycle, by means of resistor 337, thereby pulling it collector voltage and thus the voltage at connection terminal 1 repetitively to zero volts, thus forcefully commutating any SCR 112 that might have been triggered previously and to thereby keep all LED's off.

The output voltage on terminal 5 is either in the range from 12 to 32 volts, in an exemplary system, or zero, when a take control station is in control and the intensity resistor control is placed to its catching position. The input level on terminal 2 to the interface network, to accomplish the desirable output range, is in the appropriate range of 8 to 22 volts or 5 volts.

While particular embodiments of this invention have been shown and discussed, it will be understood that the invention is not limited thereto, since many modifications may be made and will become apparent to those skilled in the art. For example, the electronic resistor employed as the heart of the intensity control may be a signal generator, if desired.

What is claimed is:

1. A take control circuit for providing intensity control to a light dimming network in the form of variable dc voltage, comprising a constant current generator, a gated semiconductor device, one of the main terminals being connected to said generator, a variable electronic resistor connected to another main terminal of said device, and gate means for causing conduction of said device thereby enabling said resistor to operate as means for determining a dc voltage level for setting of light intensity.

2. A take control circuit as described in claim 1, and including a rate-control, time-constant network, said network including a memory capacitor and a variable resistor, the setting of the resistor determining the rate of change of a voltage level setting by said variable electronic resistor varies from a first level to a second level.

3. A take control circuit as described in claim 2, wherein said memory capacitor includes an electronic capacitance multiplier.

4. A take control circuit as described in claim 3, wherein said electronic capacitance multiplier includes an operational amplifier.

5. A take control circuit as described in claim 1, and including a visual indicator connected to said variable electronic resistor to show when said take control charge circuit is in charge of providing intensity control to the light dimming network.

6. A take control circuit as described in claim 1, wherein said gated semiconductor device is an SCR.

7. A take control circuit as described in claim 1, wherein said variable electronic resistor includes a transistor, the base thereof being connected to one of the main terminals of said gated semiconductor device, and a variable resistor connected to one of said emitter and collector, the other of said emitter and collector providing the output connection to the light dimming network.

8. A take control circuit as described in claim 1, wherein said gate means includes a power source connected to said constant current generator and a switch connected to said power source and the gate of said gated semiconductor device for providing a gate pulse thereto from said power source upon the momentary closing of said switch.

9. A plurality of take control circuits for providing intensity control to a light dimming network in the form of variable dc voltage, at least comprising:

a constant current generator;

a first take control circuit including a first gated semiconductor device, one of the main terminals being connected to said generator, and a first variable electronic resistor connected to another main terminal of said first device;

a second take control circuit, including a second gated semiconductor device, one of the main terminals being connected to said generator, and a second variable electronic resistor connected to another main terminal of said second device; and gate means for causing conduction of one of said first and second devices upon operator selection and causing disconnection of the other of said first and second devices, thereby enabling operation of said first and second variable resistors to operate as means for determining a dc voltage level for setting of light intensity.

10. A plurality of take control circuits as described in claim 9, wherein said gate means includes a capacitor connected to said constant current generator, a first switch connected to said capacitor and the gate of said first gated semiconductor device for providing a gate pulse thereto from said capacitor upon the momentary closing of said first switch, and a second switch connected to said capacitor and the gate of said second gated semiconductor device for providing a gate pulse thereto from said capacitor upon the momentary closing of said second switch, the momentary closing of one of said first and second switches causing a momentary decrease in voltage from said generator, thereby shutting off conduction in said first or second device previously in conduction.

* * * * *

UNITED STATES PATENT AND TRADEMARK OFFICE

CERTIFICATE OF CORRECTION

PATENT NO. : 4,144,478

DATED : Eric L. H. Nuver

INVENTOR(S) : March 13, 1979

It is certified that error appears in the above-identified patent and that said Letters Patent are hereby corrected as shown below:

Column 10, line 64, "a" should read - as --.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*